US006131248A

United States Patent [19]

Tomic

[11] Patent Number: 6,131,248

[45] Date of Patent: Oct. 17, 2000

[54] PEELABLE SEAL ON CLOSURE MECHANISM AND METHOD THEREFOR

[75] Inventor: Mladomir Tomic, Appleton, Wis.

[73] Assignee: Reynolds Consumer Products, Inc., Appleton, Wis.

[21] Appl. No.: 09/041,603

[22] Filed: Mar. 13, 1998

[51] Int. Cl.[7] ..... B65D 33/24; B65D 33/22

[52] U.S. Cl. ..... 24/304; 24/587; 220/359.3; 220/359.4; 229/123.1; 383/61; 383/63; 383/210

[58] Field of Search ..... 383/61, 63, 210, 383/5; 220/359.3, 359.4; 229/123.1, 245; 24/587, 304

[56] References Cited

U.S. PATENT DOCUMENTS

| | | | |
|---|---|---|---|
| 4,771,937 | 9/1988 | Kamada et al. | 229/123.1 |
| 4,792,240 | 12/1988 | Ausnit | 383/63 |
| 4,838,708 | 6/1989 | Holcom et al. | 383/5 |
| 4,925,316 | 5/1990 | Van Erden et al. | 383/61 |
| 4,937,040 | 6/1990 | Holcomb et al. | 383/5 |
| 5,060,848 | 10/1991 | Ewan | 383/5 |
| 5,067,822 | 11/1991 | Wirth et al. | 383/61 |
| 5,216,787 | 6/1993 | Custer et al. | 24/587 |
| 5,238,306 | 8/1993 | Heintz et al. | 383/61 |
| 5,330,269 | 7/1994 | Kamada et al. | 383/210 |
| 5,435,864 | 7/1995 | Machacek et al. | 24/587 |
| 5,489,252 | 2/1996 | May | 383/210 |
| 5,509,735 | 4/1996 | May | 383/210 |
| 5,513,915 | 5/1996 | May | 383/210 |
| 5,527,112 | 6/1996 | Dais et al. | 383/211 |
| 5,538,345 | 7/1996 | Gotoh et al. | 383/210 |
| 5,605,594 | 2/1997 | May | 156/244.22 |
| 5,628,566 | 5/1997 | Schreiter | 383/63 |
| 5,647,671 | 7/1997 | May | 383/210 |
| 5,904,425 | 5/1999 | May | 383/61 |
| 5,927,855 | 7/1999 | Tomic et al. | 383/5 |

*Primary Examiner*—Stephen P. Garbe
*Attorney, Agent, or Firm*—Alan M. Biddison

[57] ABSTRACT

A peelable seal includes four layers. The first layer includes first and second alternating ribs. The first ribs comprise a first material, and the second ribs comprise a second material. The first material bonds well with the closure profiles. The second material bonds well with the third and fourth layers. The first material does not bond well with the second material. Thus, the bond strength is lower between the first and second ribs and between the third and fourth ribs than between the first and third ribs and the closure profiles and between the second and fourth ribs and the third and fourth layers. In this process, the strength of the peelable seal is controlled during the extrusion process rather than being subjected to the variations in the manufacturing process. Alternatively, the peelable seal includes six layers. The first and second layers bond well with the closure profiles. The third and fourth layers bond well with the fifth and sixth layers. The first layer does not bond well with the third layer and the second layer does not bond well with the fourth layer. Thus, the bond strength is lower between the first and third layers and between the second and fourth layers.

13 Claims, 7 Drawing Sheets

PEELABLE SEAL ON CLOSURE MECHANISM AND METHOD THEREFOR

FIELD OF THE INVENTION

The present invention generally relates to closure arrangements for polymeric packages and, in particular, to a closure arrangement having a peelable seal.

BACKGROUND

In many consumer packaging applications, it is important to prevent air or water from passing out of or into a package containing certain products. This is particularly true with respect to meat packages, cheese packages, and the like, for which the contained product must be kept in a constant environment to prevent spoilage. In order to preserve the product contained within such a package, the periphery of the package must be hermetically sealed. Hermetic seals can be provided by both permanent seals and temporary seals, known as peelable seals. Peelable seals are usable to provide a hermetic seal and, at the same time, provide a consumer with access to the contents of the package. A consumer breaks a peelable seal of a package by first grabbing onto opposing film faces to which peelable seal materials are adhered and then pulling the film faces apart.

A common method of packaging foods, such as sliced luncheon meats and the like, is by use of a horizontal form, fill, and seal procedure. These procedures involve shaping a portion of film ("form"), placing the food article inside or upon the formed film portion ("fill"), completing the closure of the film portion around the food article and "sealing" open edges to complete the packaging process.

In some implementations, one sealing station is used to seal all the edges of a package and, at the same time, make a peelable seal from a strip of peelable materials. The "sealing" stage of the form, fill, and seal procedure often involves using a resealable closure mechanism. The resealable closure mechanism and peelable seal are often produced as separate items from the package and are attached to and made integral with the package at a later point in the manufacturing process by a heat and pressure sealing process. In most implementations, the packages are made of polymeric materials, because these materials inhibit the migration of air and water from and into the package.

To provide a peelable seal on a package with a resealable closure mechanism, the package typically uses permanent seals at its side edges and bottom edge and a peelable seal above or below the resealable closure mechanism at the mouth end of the package. In addition, the peelable seal may be arranged on either the flange/base portions of the closure mechanism or on the packaging film adjacent to the flange portions.

The strength of the peelable seal is determined by the composition of the peelable material, temperature, pressure, dwell time of the seal bars, and the size of the peelable seal. The peelable seal needs to be strong enough to provide an adequate hermetic seal, but weak enough to allow the consumer to "peel" the peelable seal apart. Peelable seals are highly susceptible to small variations that might occur during manufacturing; i.e., the peelable seals have low manufacturing tolerances. Given these manufacturing variations, it is difficult to control the strength of the peelable seal.

SUMMARY OF THE INVENTION

In one aspect of the present invention, one example embodiment involves a closure arrangement for use with a polymeric package. The closure arrangement includes a first and second base strip. Each base strip has an inner and an outer surface. The outer surfaces are adapted for attachment to the polymeric package. The closure arrangement further includes a peelable seal. The peelable seal has a first and second layer. The first layer includes first and second alternating ribs. The first ribs comprise a first material, and the second ribs comprise a second material. The first ribs are attached to the first base strip. The second layer includes third and fourth alternating ribs. The third ribs comprise the first material, and the fourth ribs comprise the second material. The third ribs are attached to the second base strip. The peelable seal further includes a third and fourth layer. The third layer overlies the first layer and is attached to the second ribs of the first layer. The fourth layer overlies the second layer and is attached to the fourth ribs of the second layer.

In another embodiment of the present invention, a closure arrangement includes a first and second base strip. Each base strip has an inner and an outer surface. The outer surfaces are adapted for attachment to the polymeric package. The closure arrangement further includes a peelable seal. The peelable seal has a first layer attached to the first base strip with a first bond strength therebetween and a second layer attached to the second base strip with a second bond strength therebetween. The peelable seal further has a third layer attached to the first layer with a third bond strength therebetween and a fourth layer attached to the second layer with a fourth bond strength therebetween. The peelable seal further has a fifth layer attached to the third layer with a fifth bond strength therebetween and a sixth layer attached to the fourth layer with a sixth bond strength therebetween. The first, second, fifth, and sixth bond strengths are greater than the third and fourth bond strengths.

According to another aspect of the present invention, a method of manufacturing a polymeric package is provided. The method includes placing a first film panel adjacent to a second film panel, sealing a plurality of edges of the first film panel to corresponding edges of the second film panel, and placing a peelable seal between an unsealed edge of the first film panel and a corresponding unsealed edge of the second film panel. The peelable seal has a first and second layer. The first layer includes first and second alternating ribs. The first ribs comprise a first material, and the second ribs comprise a second material. The first ribs are attached to the first base strip. The second layer includes third and fourth alternating ribs. The third ribs comprise the first material, and the fourth ribs comprise the second material. The third ribs are attached to the second base strip. The peelable seal further includes a third and fourth layer. The third layer overlies the first layer and is attached to the second ribs of the first layer. The fourth layer overlies the second layer and is attached to the fourth ribs of the second layer. The method further includes heat sealing the peelable seal to both the first film panel and the second film panel and fusing the third and fourth layers of the peelable seal, forming a single, resulting layer that provides a hermetic seal.

According to yet another aspect of the present invention, a method of manufacturing a polymeric package is provided. The method includes placing a first film panel adjacent to a second film panel, sealing a plurality of edges of the first film panel to corresponding edges of the second film panel, and using a peelable seal between an unsealed edge of the first film panel and a corresponding unsealed edge of the second film panel. The peelable seal has a first layer attached to the first base strip with a first bond strength therebetween and a second layer attached to the second base strip with a second bond strength therebetween. The peelable seal further has a third layer attached to the first layer with a third bond strength therebetween and a fourth layer attached to the second layer with a fourth bond strength therebetween. The peelable seal further has a fifth layer attached to the third layer with a fifth bond strength therebetween and a sixth layer attached to the fourth layer with a sixth bond strength therebetween. The first, second, fifth, and sixth bond strengths are greater than the third and fourth bond strengths.

The above summary of the present invention is not intended to describe each illustrated embodiment or every implementation of the present invention. The figures and the detailed description that follow more particularly exemplify these embodiments.

BRIEF DESCRIPTION OF THE DRAWINGS

The invention may be more completely understood in consideration of the detailed description of various embodiments of the invention that follows in connection with the accompanying drawings in which.

Figure 1:
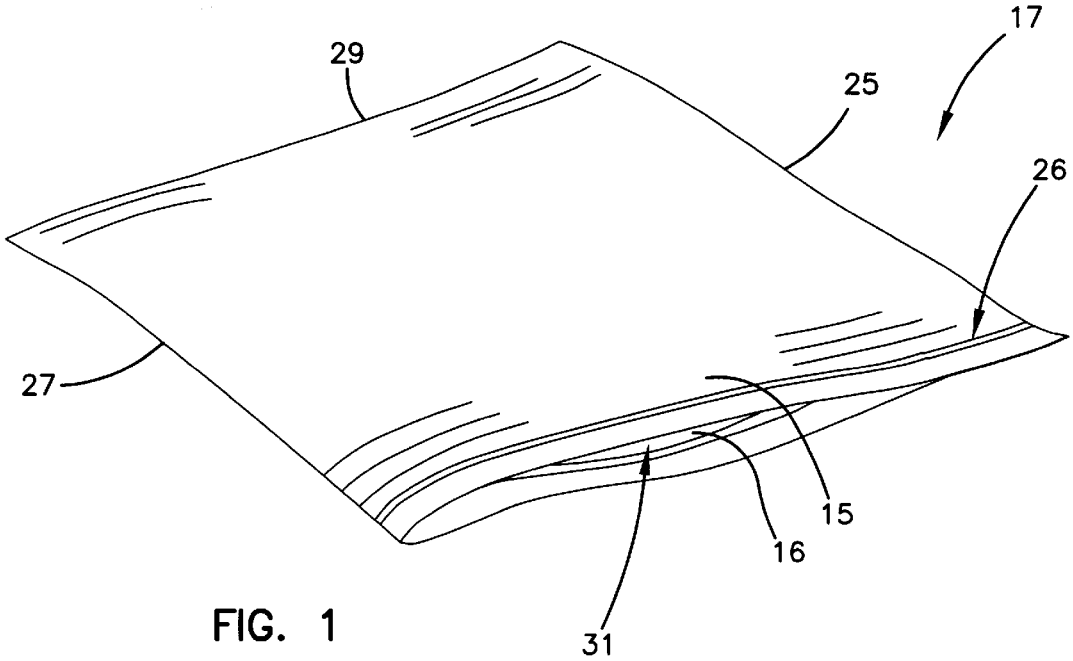
FIG. 1 is a perspective view of a flexible, resealable package according to an example embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

The present invention is believed to be applicable to a variety of packaging arrangements. The invention has been found to be particularly advantageous for use in sealing mechanisms for polymeric packages. An appreciation of various aspects of the invention is best gained through a discussion of an application example for such a packaging arrangement.

Figure 2:
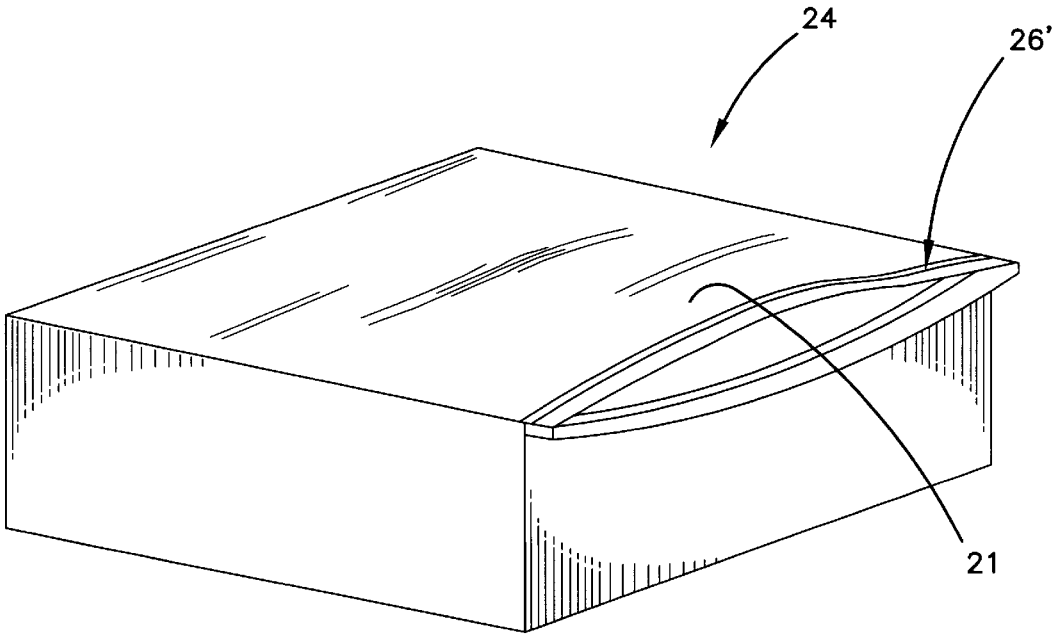
FIG. 2 is a perspective view of a rigid, resealable package also according to an example embodiment of the present invention.

According to an example embodiment of the present invention, a peelable seal is coextruded with a resealable closure mechanism to provide consistent and controlled strength of the peelable seal. FIGS. 1 and 2 illustrate example types of packages 17, 24 that benefit from use of such peelable seals.

FIG. 1 illustrates an example packaging arrangement in the form of a resealable, flexible package 17 having a zipper-type closure mechanism 26 constructed in accordance with the present invention. The flexible package 17 includes first and second opposed panel sections 15, 16 made from a flexible, polymeric film. For some manufacturing applications, the first and second panel sections 15, 16 are heat-sealed together along two edges 25, 27 and meet at a fold line in order to form a three-edged containment section for a product within the interior of the package 17. The fold line comprises the bottom edge 29. Alternatively, two separate panel sections 15, 16 of polymeric film may be used and heat-sealed together along the two edges 25, 27 and at the bottom 29. Access is provided to the interior of the package 17 through a mouth 31. In other implementations, the package 17 includes tear strings and/or notches at the mouth 31 to assist with opening the package 17.

FIG. 2 is a perspective view depicting a rigid resealable package 24. The rigid resealable package 24 has the same basic features as the flexible resealable package 17 of FIG. 1. The package 24, however, has a flexible top side 21. The remaining five sides are either rigid, flexible, or a combination of rigid and flexible.

A resealable closure mechanism 26 is illustrated in FIG. 1 at the opening of the flexible package 17. A similar closure mechanism 26' is illustrated in FIG. 2. Each closure mechanism 26 or 26' extends the width of the package 17 or 24. Each closure mechanism 26 or 26' can be one of a variety of closure mechanisms. In the particular embodiment illustrated in FIG. 3, the resealable closure mechanism 26 of FIG. 1 is shown in the specific form of a zipper-type mechanism. The resealable closure mechanism 26 includes an elongated male closure profile 28 and an elongated female closure profile 30. The male closure profile 28 is comprised of a base strip 42 and an interlocking closure member 44. Base strip 42 is attached to the first package film 15. The female closure profile 30 is likewise comprised of a base strip 51 and an interlocking closure member 53. Base strip 51 is attached to the second package film 16. A resealable closure mechanism such as this is described in U.S. Pat. No. 5,486,051, hereby incorporated by reference.

Figure 3:
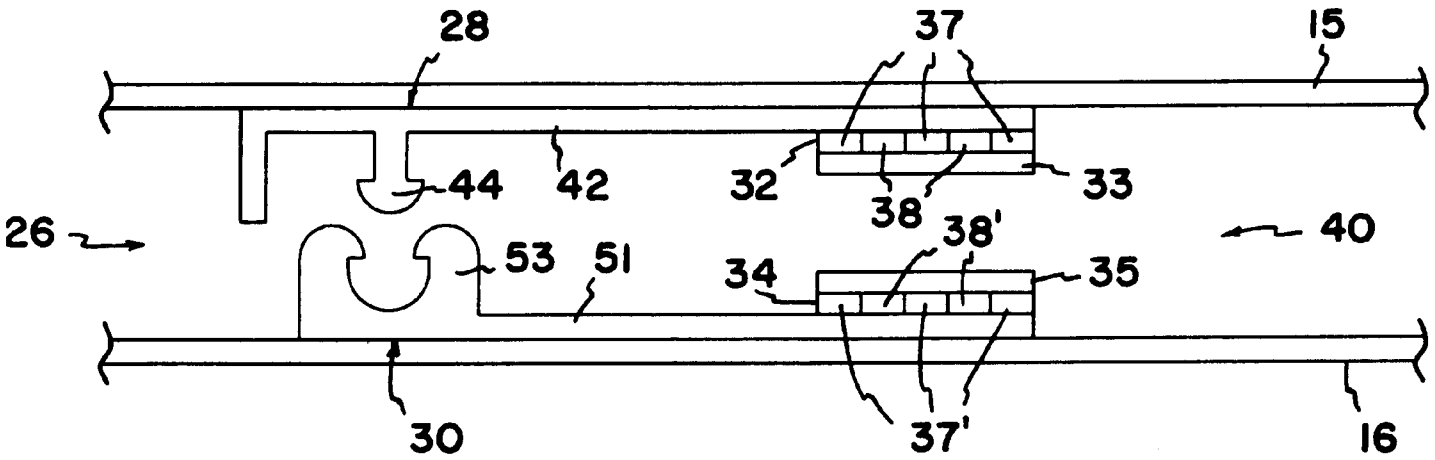
FIG. 3 is a fragmented, cross-sectional, somewhat schematic view of a resealable closure mechanism with a peelable seal, also according to a first example embodiment of the present invention.

Still in reference to FIG. 3, a peelable seal, according to an example embodiment of the invention, is illustrated generally at 40. The peelable seal 40 includes a first peelable layer 32, a first sealant layer 33, a second peelable layer 34, and a second sealant layer 35.

In the example embodiment illustrated in FIG. 3, the closure arrangement is manufactured using conventional extrusion and heat sealing techniques. In particular, the closure profiles 28, 30, the peelable layers 32, 34, and the sealant layers 33, 35 are coextruded through a die plate fed by a plurality of extruders. These extruders carry different molten materials for forming the closure profiles 28, 30, the peelable layers 32, 34, and the sealant layers 33, 35. As is well-known in the art, the die plate includes input ports, output ports, and channels connecting these input ports to output ports. The extruders feed the different molten materials to different input ports, and the channels are designed to configure the molten materials into the shapes of the closure profiles 28, 30, the peelable layers 32, 34, and the sealant layers 33, 35.

Generally, the closure profiles 28, 30 are extruded from a polymeric resin such as polyethylene. The sealant layers 33, 35 are extruded from a material that heat-fuses easily during a typical heat and pressure seal process. For example, the sealant layers 33, 35 are extruded from a polyethylene resin. The first peelable layer 32 includes alternating first and second ribs 37, 38. The second peelable layer 34 includes alternating third and fourth ribs 37', 38'. The first and third ribs are extruded from a first material. The first material bonds well with the base strips 42, 51 of the closure profiles 28, 30. For example, the first material comprises a polyethylene blend. By "bonds well," it is meant that the bond strength is greater than about six pounds per linear inch. The second and fourth ribs 38, 38' are extruded from a second material. The second material bonds well with the sealant layers 33, 35. For example, the second material comprises a polypropylene blend, a polybutylene blend, or a combination thereof.

The bond strength between the first and second ribs 37, 38 and between the third and fourth ribs 37', 38' determines the strength of the peelable seal 40. The bond strength between the first and second ribs 37, 38 and between the third and fourth ribs 37', 38' is weak. By "weak," it is meant that the bond strength is typically from about 0.5 to 6 pounds per linear inch. This strength provides an adequate hermetic seal while still allowing the consumer to "peel" the peelable seal 40 apart.

The die plate for the peelable layers 32, 34 is arranged and configured to extrude the first and second ribs 37, 38 and the third and fourth ribs 37', 38' in a ribbed fashion, alternating ribs of the first material with ribs of the second material within the peelable layers 32, 34 as illustrated in FIG. 3. In this process, the first and third ribs 37, 37' are bonded to the base strips 42, 51, respectively, and the second and fourth ribs 38, 38' are bonded to the sealant layers 33, 35, respectively. This process causes the peelable layers 32, 34 to have a lower bond strength than the package films 15, 16, the closure profiles 28, 30, including base strips 42, 51, and the sealant layers 33, 35. The bond strength between the first rib 37 and the first base strip 42, between the third rib 37' and the second base strip 51, between the second ribs 38 and the first sealant layer 33, and between the fourth ribs 38' and the second sealant layer 35 is greater than six pounds per linear inch, while the bond strength between the first and second ribs 37, 38 and between the third and fourth ribs 37', 38' is no greater than six pounds per linear inch, typically about 0.5 to 6 pounds per linear inch. In one embodiment, the ribs 38, 38' may be omitted to provide air gaps between the ribs 37, 37'.

The bond strength of the peelable layers 32, 34 can be controlled by the length of time that the first and third ribs 37, 37' are in contact with the base strips 42, 51, respectively, and by the length of time the second and fourth ribs 38, 38' are in contact with the sealant layers 33, 35, respectively. Further control of the bond strength of the peelable seal 40 is obtained by varying the melt temperature of each of the different materials of the closure profiles 28, 30, the peelable layers 32, 34, and the sealant layers 33, 35. This process allows the strength of the peelable seal 40 to be precisely controlled rather than subjecting the strength of the peelable seal 40 to the manufacturing tolerances of the heat and pressure seal process.

Figure 4:
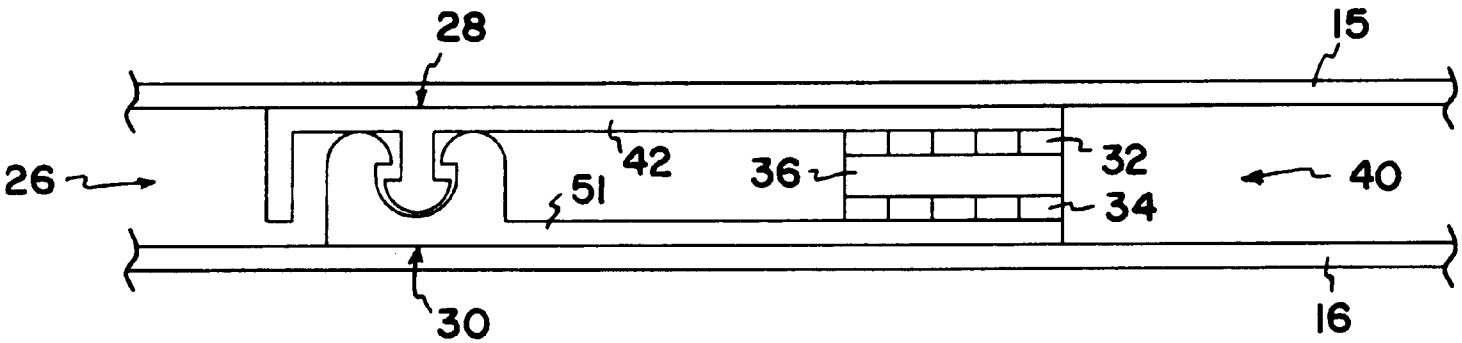
FIG. 4 is a fragmented, cross-sectional, somewhat schematic view of a resealable closure mechanism with an activated peelable seal, also according to a first example embodiment of the present invention.

After manufacturing, the closure profiles 28, 30 are interlocked, and the first sealant layer 33 is located opposite and adjacent to the second sealant layer 35. The closure arrangement is then attached to the package films 15, 16 by a conventional heat and pressure seal process. Attention is directed to FIG. 4. This process causes the package films 15, 16 to heat-fuse with the base strips 42, 51. This process further causes the first sealant layer 33 of FIG. 3 to heat-fuse with the second sealant layer 35 of FIG. 3 such that one fused layer 36 of FIG. 4 results, providing a hermetic seal.

Figure 5:
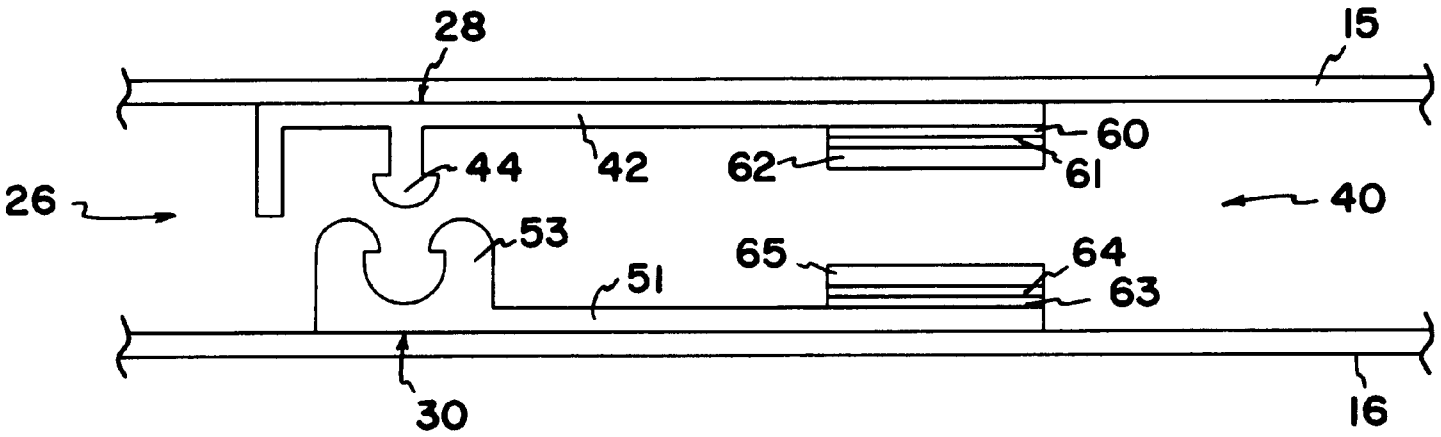
FIG. 5 is a fragmented, cross-sectional, somewhat schematic view of a resealable closure mechanism with a peelable seal, according to a second example embodiment of the present invention.

Attention is directed to FIG. 5. In yet another embodiment, the peelable seal 40 includes a first peelable layer 60, a second peelable layer 61, a first sealant layer 62, a third peelable layer 63, a fourth peelable layer 64, and a second sealant layer 65. The closure profiles 28, 30, including the base strips 42, 51, and the sealant layers 62, 65 are comprised of the same material, such as polyethylene. The first and third peelable layers 60, 63 are comprised of a polyethylene blend. The second and fourth peelable layers 61, 64 are also comprised of a polyethylene blend. This blend bonds well with polyethylene. In this embodiment, the bond strength of the peelable layers 60, 61, 63, 64 is controlled by varying the length of time each layer is in contact with its respective outer layer prior to tooling. For example, the first and third peelable layers 60, 63 are extruded with the closure profiles 28, 30, respectively. The second and fourth peelable layers 61, 64 are extruded with the sealant layers 62, 65, respectively. The first peelable layer 60 is combined with the second peelable layer 61 after tooling. Likewise, the third peelable layer 63 is combined with the fourth peelable layer 64 after tooling.

This process results in a higher bond strength between the first peelable layer 60 and the male closure profile 28 and between the second peelable layer 61 and the first sealant layer 62 than between the first peelable layer 60 and the second peelable layer 61. Likewise, the bond strength between the third peelable layer 63 and the female closure profile 30 and between the fourth peelable layer 64 and the second sealant layer 65 is higher than between the third peelable layer 63 and the fourth peelable layer 64. The bond strengths between the first peelable layer 60 and the second peelable layer 61 and between the third peelable layer 63 and the fourth peelable layer 64 determine the strength of the peelable seal 40. This bond strength is no greater than six pounds per linear inch, typically about 0.5 to 6 pounds per linear inch. This strength provides an adequate hermetic seal while still allowing the consumer to "peel" the peelable seal 40 apart. The bond strength between the first peelable layer 60 and the male closure profile 28 and between the second peelable layer 61 and the first sealant layer 62 is greater than six pounds per linear inch. Likewise, the bond strength between the third peelable layer 63 and the female closure profile 30 and between the fourth peelable layer 64 and the second sealant layer 65 is greater than six pounds per linear inch.

Figure 6:
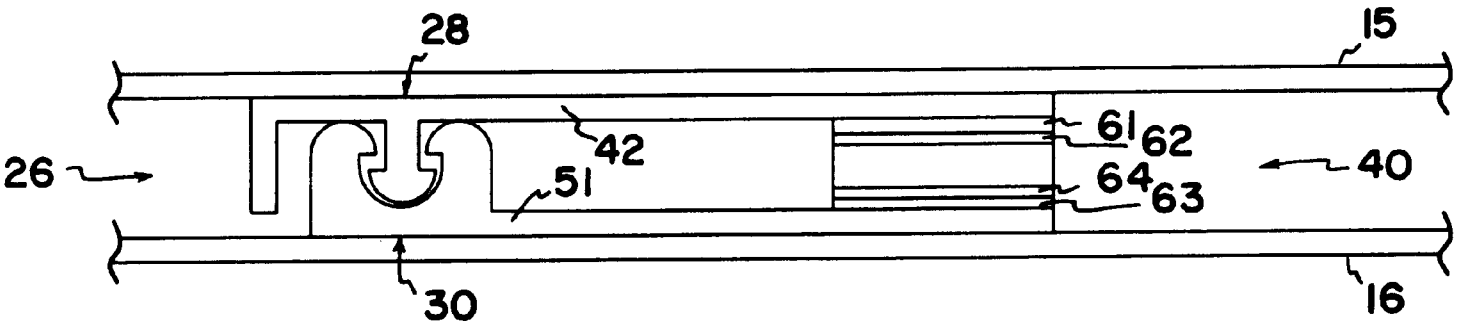
FIG. 6 is a fragmented, cross-sectional, somewhat schematic view of a resealable closure mechanism with an activated peelable seal, also according to a second example embodiment of the present invention.

After manufacturing, the closure profiles 28, 30 are interlocked, and the first sealant layer 62 is located opposite and adjacent to the second sealant layer 65. The closure arrangement is then attached to the package films 15, 16 by a conventional heat and pressure seal process. Attention is directed to FIG. 6. This process causes the package films 15, 16 to heat fuse with the base strips 42, 51. This process further causes the first sealant layer 62 of FIG. 5 to heat-fuse with the second sealant layer 65 of FIG. 5 such that one fused layer 66 of FIG. 6 results, providing a hermetic seal.

In yet another embodiment, the peelable seal 40 exists without the interlocking closure mechanisms 28, 30. In this embodiment, the peelable seal 40 is coextruded with the base strips 42, 51 and then heat-fused to the package films 15, 16 as described previously.

The peelable seal 40 provides a hermetic seal at the mouth 31 of the package 17 of FIG. 1. The hermetic seal prevents air and water from penetrating the package films. This keeps the contents of the package in a constant environment to prevent spoilage.

Prior to initially opening a package incorporating either the closure arrangement shown in FIG. 4 or the one shown in FIG. 6, the peelable seal 40 is intact, the closure profiles 28, 30 are interlocked with each other, and the first and second films 15, 16 are connected at the mouth end 31 of the package 17 shown in FIG. 1. The first and second films 15, 16 are heat-fused together at the mouth end 31 of the package 17. Because the peelable seal 40 already provides a hermetic seal for the package, the first and second films 15, 16 may alternatively be disconnected from each other at the mouth end 31 of the package 17.

Figure 7:
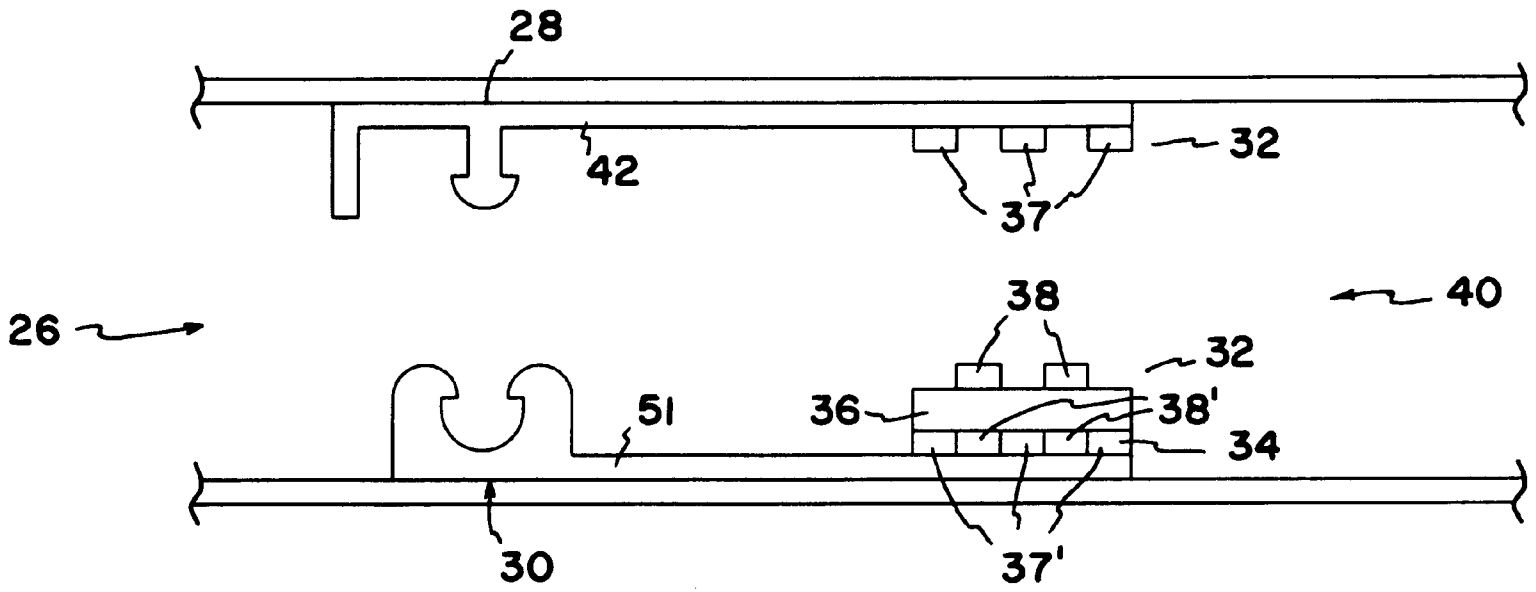
FIG. 7 is a fragmented, cross-sectional, somewhat schematic view of a resealable closure mechanism with a broken peelable seal, according to the first example embodiment of the present invention.
Figure 8:
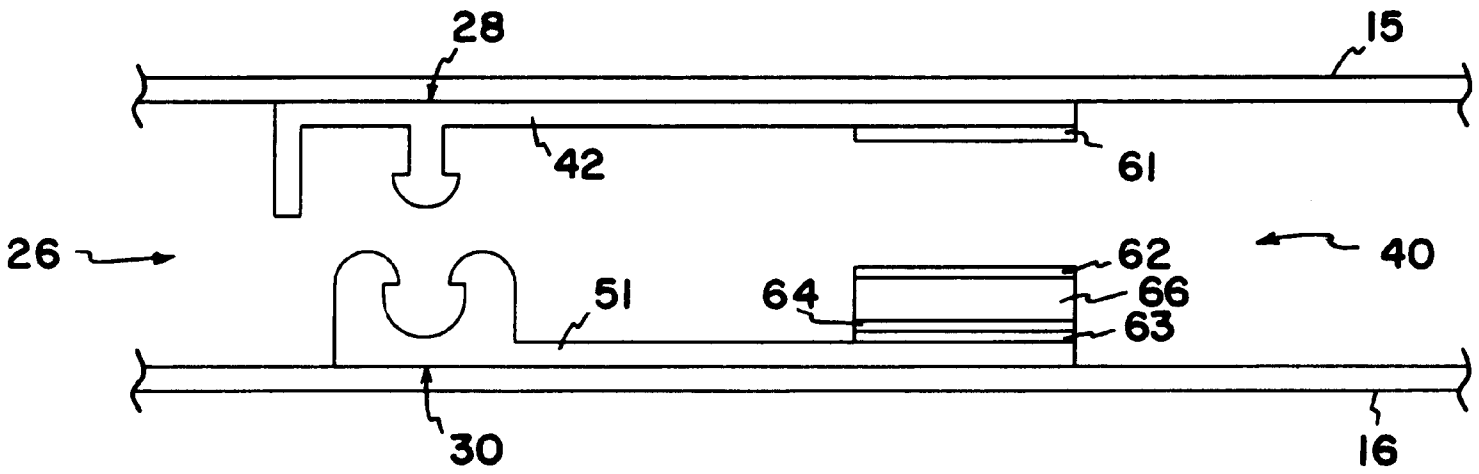
FIG. 8 is a fragmented, cross-sectional, somewhat schematic view of a resealable closure mechanism with a broken peelable seal, also according to the second example embodiment of the present invention.

To open the package 17, the first and second films 15, 16 are separated from each other by cutting them apart. Attention is directed to FIGS. 7 and 8. Next, the interlocked closure profiles 28, 30 are detached from each other by grabbing onto the first and second films 15, 16 and pulling them apart. Finally, the peelable seal 40 is broken by continuing to pull the first and second films 15, 16 in opposite directions. In FIG. 7, the peelable seal 40 is broken between the first ribs 37 and the second ribs 38, because of the weaker bond strength. Alternatively, the peelable seal 40 is broken between the third ribs 37' and the fourth ribs 38'. In FIG. 8, the peelable seal 40 is broken between the first peelable layer 61 and the second peelable layer 62, because of the weaker bond strength. Alternatively, the peelable seal 40 is broken between the third peelable layer 63 and the fourth peelable layer 64.

The above specification and examples are believed to provide a complete description of the manufacture and use of particular embodiments of the invention. Many embodiments of the invention can be made without departing from the spirit and scope of the invention.

I claim:

1. A closure arrangement for use with a polymeric package having first and second opposing film panels, comprising:

first and second opposing base strips each having an inner and outer surface, the outer surfaces of the first and second opposing base strips being adapted for attachment to respective first and second film panels of the polymeric package; and a peelable seal including:

a first layer including first and second alternating ribs; the first ribs comprising a first material, and the second ribs comprising a second material;

the first ribs being attached to the first base strip;

a second layer comprising third and fourth alternating ribs; the third ribs comprising the first material, and the fourth ribs comprising the second material;

the third ribs being attached to the second base strip;

a third layer overlying the first layer; the third layer being attached to the second ribs of the first layer; and a fourth layer overlying the second layer; the fourth layer being attached to the fourth ribs of the second layer.

2. A closure arrangement for use with a polymeric package according to claim 1, wherein the first and second opposing base strips further have an interlocking closure member on each respective inner surface to provide a resealable closure mechanism.

3. A closure arrangement for use with a polymeric package according to claim 2, wherein each of the interlocking closure members comprises at least one of a male interlocking closure member and a female interlocking closure member.

4. A closure arrangement for use with a polymeric package according to claim 1, wherein the third and fourth layers fuse to form a single, resulting layer providing a hermetic seal.

5. A closure arrangement for use with a polymeric package according to claim 1, wherein the first and second base strips and the peelable seal comprise a polymeric material.

6. A closure arrangement for use with a polymeric package according to claim 1, wherein the third and fourth layers comprise a different material than the first and second base strips.

7. A closure arrangement for use with a polymeric package according to claim 1, wherein:

the first ribs and the first base strip have a first bond strength therebetween;

the third ribs and the second base strip have a second bond strength therebetween;

the second ribs and the third layer have a third bond strength therebetween;

the fourth ribs and the fourth layer have a fourth bond strength therebetween;

the first ribs and the second ribs of the first layer have a fifth bond strength therebetween;

the third ribs and the fourth ribs of the second layer have a sixth bond strength therebetween; and the first, second, third, and fourth bond strengths are greater than the fifth and sixth bond strengths.

8. A closure arrangement for use with a polymeric package according to claim 7, wherein the first, second, third, and fourth bond strengths are greater than six pounds per linear inch.

9. A closure arrangement for use with a polymeric package according to claim 6, wherein the first and second base strips comprise polyethylene.

10. A closure arrangement for use with a polymeric package according to claim 6, wherein the third and fourth layers comprise polypropylene.

11. A closure arrangement for use with a polymeric package according to claim 9, wherein the first and third ribs comprise a polyethylene blend.

12. A closure arrangement for use with a polymeric package according to claim 10, wherein the second and fourth ribs comprise a polypropylene blend.

13. A closure arrangement for use with a polymeric package having first and second opposing film panels, comprising:

first and second opposing base strips each having an inner and outer surface, the outer surfaces of the first and second opposing base strips being adapted for attachment to respective first and second film panels of the polymeric package; and a peelable seal including:

a first layer including spaced apart first ribs attached to the first base strip;

a second layer comprising spaced apart second ribs; the second ribs attached to the second base strip;

a third layer overlying the first layer; the third layer being attached to the first ribs of the first layer; and a fourth layer overlying the second layer; the fourth layer being attached to the second ribs of the second layer.

* * * * *